US006243325B1

(12) United States Patent
Tomono

(10) Patent No.: US 6,243,325 B1
(45) **Date of Patent: *Jun. 5, 2001**

(54) CALENDAR MANAGEMENT SYSTEM AND CALENDAR DISPLAY CONTROL METHOD AND COMPUTER READABLE RECORD MEDIUM HAVING CALENDAR MANAGEMENT PROGRAM RECORDED THEREON

(75) Inventor: Kazuo Tomono, Inagi (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/124,995

(22) Filed: Jul. 30, 1998

(30) Foreign Application Priority Data

Mar. 17, 1998 (JP) ..... 10-066684

(51) Int. Cl.[7] ..... G04B 19/24

(52) U.S. Cl. ..... 368/28

(58) Field of Search ..... 368/10, 41, 28

(56) References Cited

U.S. PATENT DOCUMENTS 1,968,444 * 7/1934 Farber ..... 368/41
5,199,009 * 3/1993 Svast ..... 368/240

FOREIGN PATENT DOCUMENTS 7-282131 10/1995 (JP) .

* cited by examiner

*Primary Examiner*—Bernard Roskoski
(74) *Attorney, Agent, or Firm*—Staas & Halsey LLP

(57) ABSTRACT

By use of a start date specifying unit, any date in one month is specified as a start day to be positioned at the head of a calendar display. The layout creating unit creates a layout of a calendar for one month with the specified start day ahead. The calendar display unit displays a calendar in conformity with the contents of creation by the layout creating unit, for example, such a calendar including 21 in each month to 20 in the next month.

17 Claims, 10 Drawing Sheets

FIG. 7

| | ARRAY No. | YEAR/MONTH/DAY /DAY-OF-WEEK |
|---|---|---|
| | 0 | 1997/11/01 SAT |
| | 1 | 1997/11/02 SUN |
| | 2 | 1997/11/03 MON |
| | ⋮ | ⋮ |
| | 20 | 1997/11/20 THU |
| START DAY ⇨ | 21 | 1997/10/21 TUE |
| | 22 | 1997/10/22 WED |
| | 23 | 1997/10/23 THU |
| | ⋮ | ⋮ |
| | 29 | 1997/10/30 THU |
| | 30 | 1997/10/31 FRI |

FIG. 9

| | ARRAY No. | YEAR/MONTH/DAY /DAY-OF-WEEK |
|---|---|---|
| | 11 | 1997/11/01 SAT |
| | 12 | 1997/11/02 SUN |
| | 13 | 1997/11/03 MON |
| | ⋮ | ⋮ |
| | 30 | 1997/11/20 THU |
| START DAY ⇨ | 0 | 1997/10/21 TUE |
| | 1 | 1997/10/22 WED |
| | 2 | 1997/10/23 THU |
| | ⋮ | ⋮ |
| | 9 | 1997/10/30 THU |
| | 10 | 1997/10/31 FRI |

FIG. 10

| | | | | | | |
|---|---|---|---|---|---|---|
| 0 | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | 32 | 33 | 34 |

CALENDAR MANAGEMENT SYSTEM AND CALENDAR DISPLAY CONTROL METHOD AND COMPUTER READABLE RECORD MEDIUM HAVING CALENDAR MANAGEMENT PROGRAM RECORDED THEREON

BACKGROUND OF THE INVENTION

1. Field of the Invention

The present invention relates generally to a calendar management system and a calendar display control method, for providing a display of a calendar in compliance with a calendar form for one month, as well as a computer readable record medium on which is recorded a calendar management program, and more particularly to a calendar management system and a calendar display control method, allowing a start day at the head of a calendar to be arbitrarily set, as well as a computer readable record medium having a calendar management program recorded thereon.

2. Description of the Related Art

Recent information equipment such as personal computers, electronic datebooks, etc., typically employ calendar management systems. In order to manage schedules of individuals or groups, most of these calendar management systems allow the calendars to be viewed on a month-to-month basis, a week-to-week basis or day-to-day basis. The display form upon the display of a calendar for one month is fixed to a display form in which days-of-week are arranged with Sunday ahead, starting from 1 in each month as in the case of the ordinary calendars. However, in such a fixed calendar display form it is inconvenient for the user's schedule management, so that some of the calendar management systems are configured to allow a display of a calendar for one month with a day-of-week desired by the user ahead or a display of a calendar for one month starting from a week desired by the user (Japanese Patent Laid-open Pub. No. Hei 7-282131).

For example, in cases where a one-month business term of a company is from 21 in each month to 20 in the next month and hence it is desired to display a calendar starting from 21 for each month, however, it was hard for the conventional calendar management allow the specification of a day-of-week or a week positioned at the top of the calendar to fulfill the user's need since an extremely complicated operation was required. That is, to provide a calendar display from Oct. 21, 1997 to Nov. 20, 1997, the user must first find out that Oct. 21, 1997 corresponds to Tuesday, and then change the calendar form into another calendar form for one month with Tuesday ahead. Then from the fact that Oct. 21, 1997 is positioned in the third week in the calendar form with Tuesday ahead, another change is made into a calendar form for one month starting from the third week. In addition, for the next one month from Nov. 21, 1997 to Dec. 20, 1997, the user at the time of Nov. 21, 1997 must again make a change into a calendar form with Tuesday ahead and change into a calendar form starting from a week containing Nov. 21, 1997. For this reason, the conventional month-to-month calendar management system has suffered from a deficiency that it is difficult to appropriately fulfill the user's demand to display one-month calendar starting from an arbitrary date.

SUMMARY OF THE INVENTION

According to the present invention there is provided a calendar management system and a calendar display control method, capable of automatically displaying a calendar for one month with a date desired by the user ahead, as well as a computer readable record medium on which is recorded a calendar management program.

The present invention provides a calendar management system for providing a display of a calendar in conformity with a calendar display form for one month, the calendar management system comprising a start date specifying unit for specifying any date in one month as a start day of a calendar display; a layout creating unit for creating a layout of a calendar for one month with the start day specified by the start date specifying unit ahead; and a calendar display processing unit for allowing a display of a calendar in conformity with the contents of creation of the layout creating unit. According to the calendar management system of the present invention, it is sufficient for the user to specify a start day in order to automatically display a calendar for one month with the specified date ahead, allowing the display of the calendar to be easy to perform in case for example the business term of a company has a time schedule from 21 in each month to 20 in the next month.

The layout creating unit creates a calendar layout for one month including dates from the specified start day to the last day of a month containing the specified day and dates from the first day in the next month to the previous day of a corresponding day of the specified start day. When a month containing the specified day is December, the layout creating unit creates a calendar layout for one month including dates from the specified start day to the last day of a month containing the specified day and dates from the first day in January in the next year to the previous day of a corresponding day of the specified start day. The calendar management system of the present invention further comprises a start day-of-week specifying unit for specifying any day-of-week as a start day-of-week in one month, and in this case the layout creating unit further changes, for creation a layout of a calendar for one month which has been changed to have at its leading position a start day specified by the start date specifying unit, into a layout of a calendar for one month which has at its leading position a start day-of-week specified by the start day-of-week specifying unit. More specifically, the start day-of-week specifying unit specifies Sunday as a start day-of-week in one month at the time of display, and the layout creating unit further changes, for creation a layout of a calendar for one month which has been changed to have at its leading position a start day specified by the start date specifying unit, into a layout of a calendar for one month which has at its leading position Sunday specified by the start day-of-week specifying unit.

The present invention further provides a calendar display control method for controlling a calendar display in conformity with a calendar display form for one month, the method comprising a start date specification step for setting any specified date as a start day of a calendar display; a layout creation step for creating a layout of a calendar for one month with the specified date ahead; and a calendar display processing step for providing a display of a calendar in conformity with the created layout. The details of this calendar display control method is substantially the same as those of the calendar management system.

The present invention further provides a computer readable record medium on which is recorded a calendar management program for providing a display of a calendar in conformity with a calendar display form for one month, the record medium comprising a start date specifying module for specifying any date in one month as a start day of a calendar display at the time of the display; a layout creating module for creating a layout of a calendar for one month with the start day specified by the start date specifying module ahead; and a calendar display processing module for allowing a display of a calendar in conformity with the contents of creation of the layout creating module. The details of this computer readable record medium on which is recorded a calendar management program are also substantially the same as those of the calendar management system.

The above and other objects, features and advantages of the present invention will become more apparent from the following detailed description with reference to the accompanying drawings.

BRIEF DESCRIPTION OF THE DRAWINGS

FIG. 7 is an explanatory diagram of an initial array in a calendar layout;

FIG. 9 is an explanatory diagram of a changed array in the calendar layout; and FIG. 10 is an explanatory diagram of segments corresponding to a screen display array for use in the calendar display processing of FIG. 2.

DETAILED DESCRIPTION OF THE PREFERRED EMBODIMENTS

Figure 1:
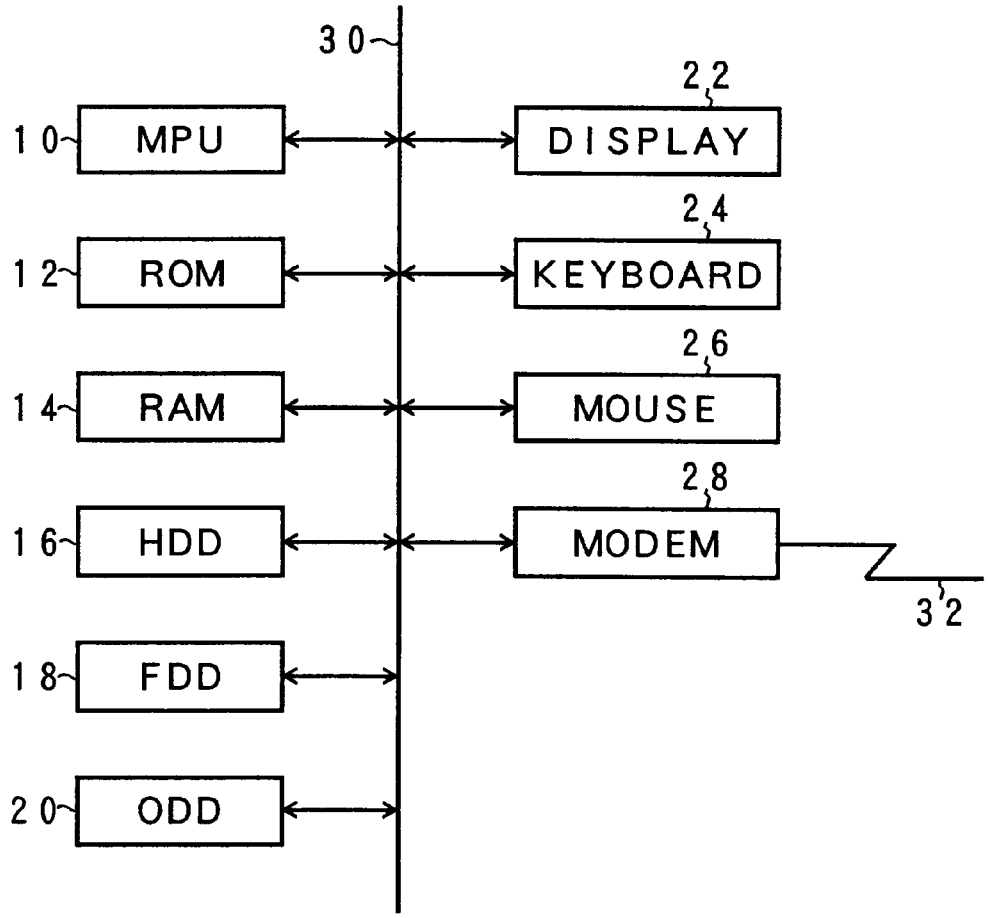
FIG. 1 is a block diagram showing an example of a hardware configuration of the present invention.

FIG. 1 is a block diagram showing a hardware configuration of a personal computer to which is applied a calendar management system in accordance with the present invention. Connected to a bus 30 led out of an MPU 10 are a RCM 12 storing a program therein and a RAM 14 for use as a work memory. Further connected thereto are an HDD (hard disk drive) 16, an FDD (floppy disk drive) 18, and an ODD (optical disk drive) 20, which are I/O units for saving information. Connected thereto as user interfaces are a display 22, a keyboard 24 and a mouse 26. Further connectable via a modem 28 is a communication line 32 such as a LAN.

Figure 2:
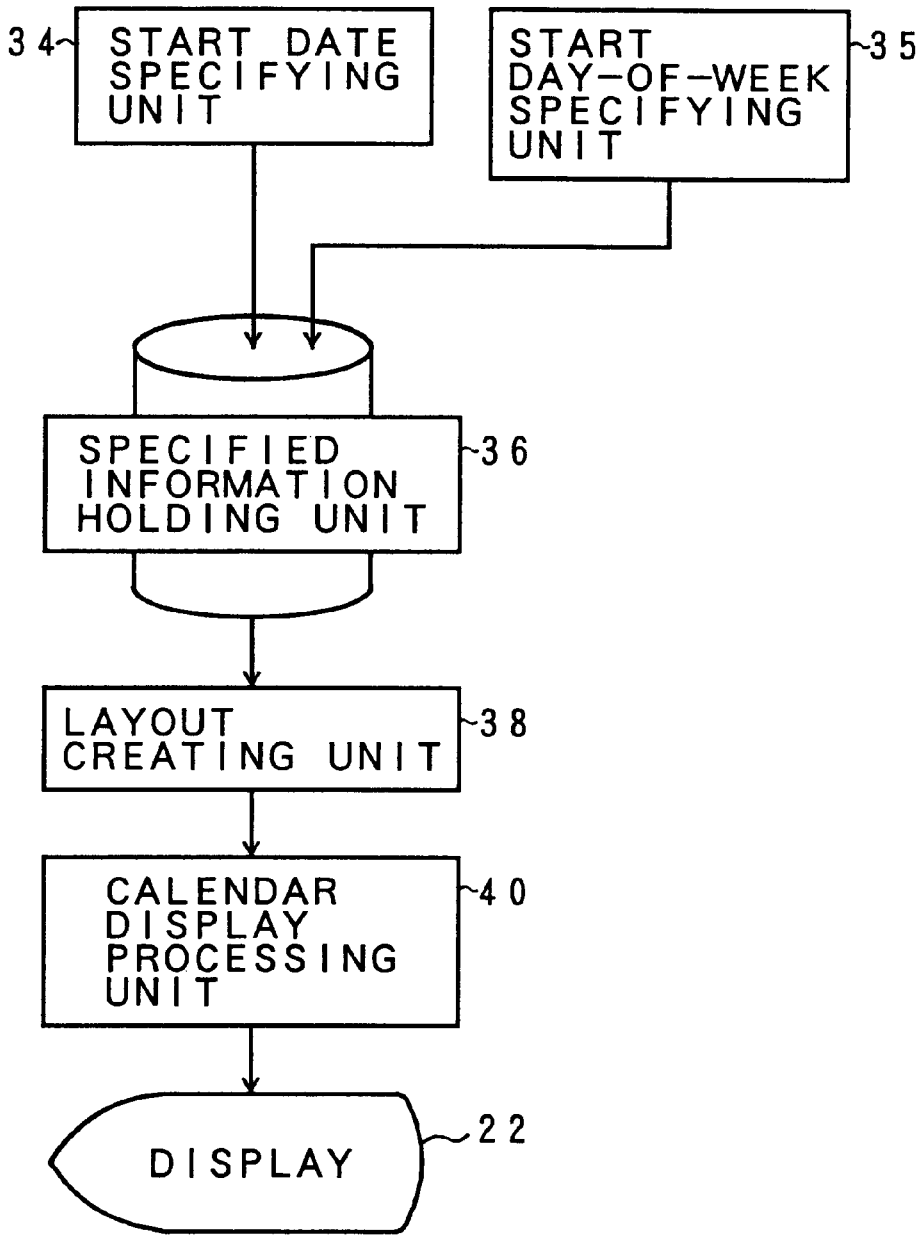
FIG. 2 is a function block diagram of the present invention.

FIG. 2 is a function block diagram of the calendar management system of the present invention implemented by a program control of the MPU 10 of FIG. 1. The calendar management system of the present invention comprises a start date specifying unit 34, a start day-of-week specifying unit 35, a specified information holding unit 36, a layout creating unit 38 and a calendar display processing unit 40 as well as the display 22. For a calendar displayed in conformity with a calendar display form for one month, the start date specifying unit 34 specifies upon a display of the calendar a start date which is an arbitrary date within one month to be placed at a leading position of the calendar display. The start day-of-week specifying unit 35 specifies Sunday for example as a start day-of-week within one month similarly upon a display of the calendar. The start date specifying unit 34 and the start day-of-week specifying unit 35 are implemented through an operation screen as in FIG. 3 for example.

Figure 3:
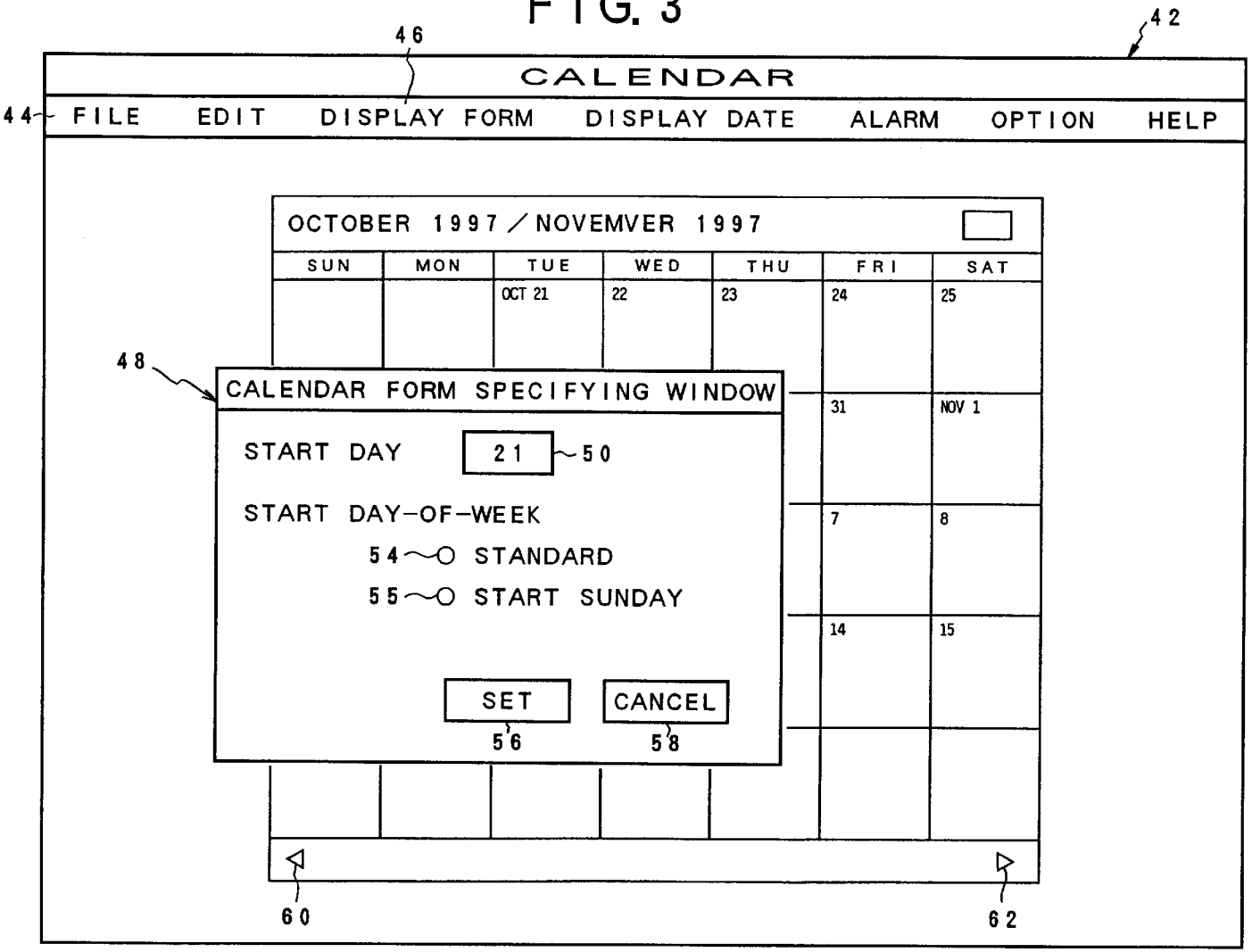
FIG. 3 is an explanatory diagram of starting date and starting day-of-week specifying units of the present invention.

FIG. 3 illustrates a calendar display screen 42 appearing on the display 22, on which a calendar form specification window 48 is displayed by mouse clicking a display format 46 for example in a control section 44 positioned at the top of the screen 42. The calendar form specification window 48 is provided with a start day specification frame 50 entered by the user, in which "21" is specified as a start day in this example. In order to select a start day-of-week following the start day, there are provided a standard specification check box 54 and a Sunday specification check box 55. When the standard specification check box 54 is clicked with the mouse, a calendar form display is carried out in which the leading day-of-week is a day-of-week of the start day "21" specified in the start day specification frame 50. On the contrary, when the Sunday specification check box 55 is clicked with the mouse, another calendar form display is carried out in which Sunday is the leading day-of-week. After the completion of such a specification of the start day or the start day-of-week, a set key 56 is clicked with the mouse to change the calendar form. Naturally, if cancellation is desired, a cancel key 58 can be clicked with the mouse.

Referring again to FIG. 2, the start day and the start day-of-week specified by the start date specifying unit 34 and the start day-of-week specifying unit 35, respectively, are saved in the specified information holding unit 36 using the HDD 16, etc., of FIG. 1. The layout creating unit 38 executes a change in layout of the calendar form on the basis of the start day and the start day-of-week saved in the specified information holding unit 36. That is, in the case of the specification of the start day, it changes the layout of a calendar for one month with the specified start day ahead. The result of this change is displayed on the display 22 by the calendar display processing unit 40.

Figure 4:
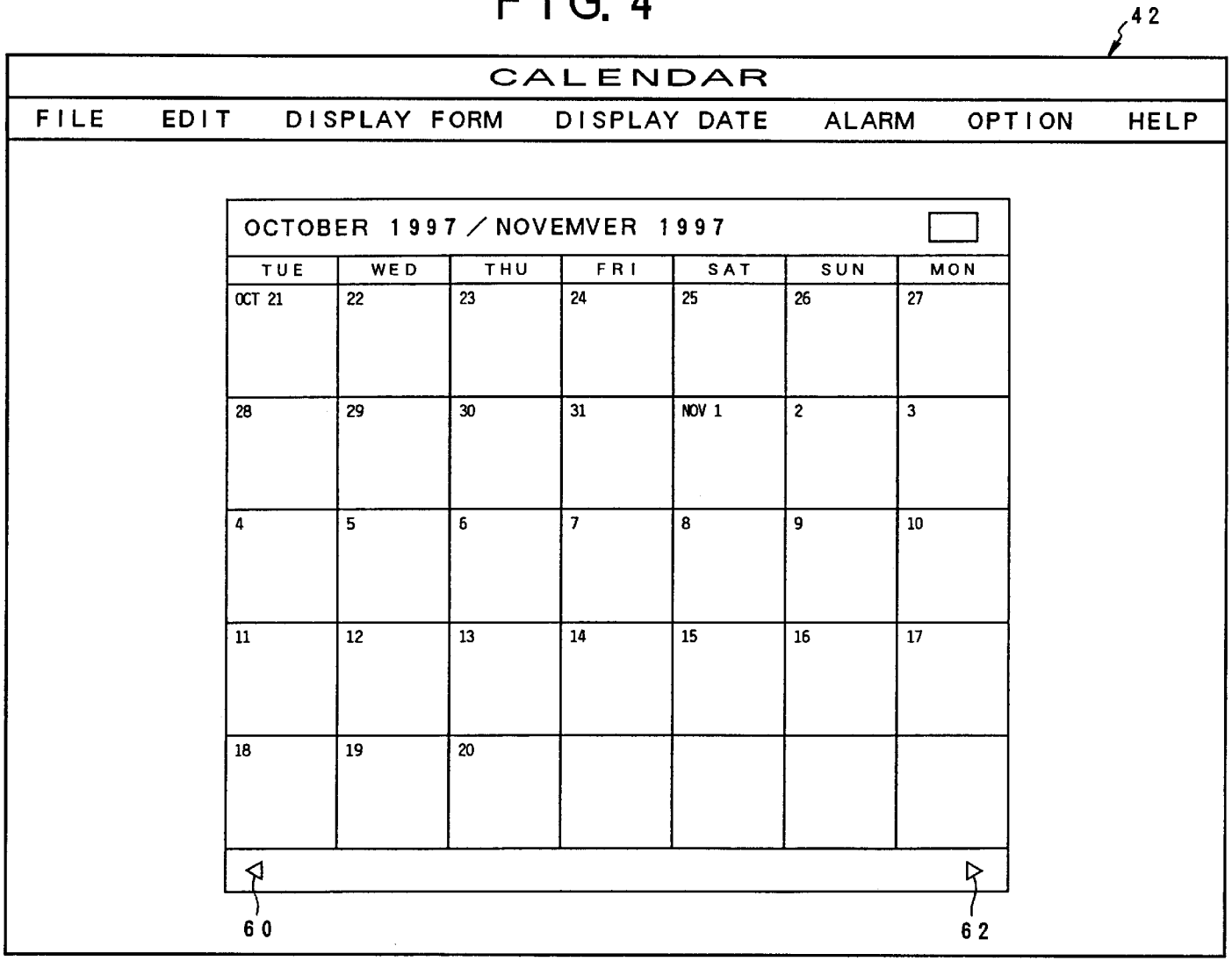
FIG. 4 is an explanatory diagram of a calendar display screen in accordance with the present invention, with the starting day set to 21.
Figure 5:
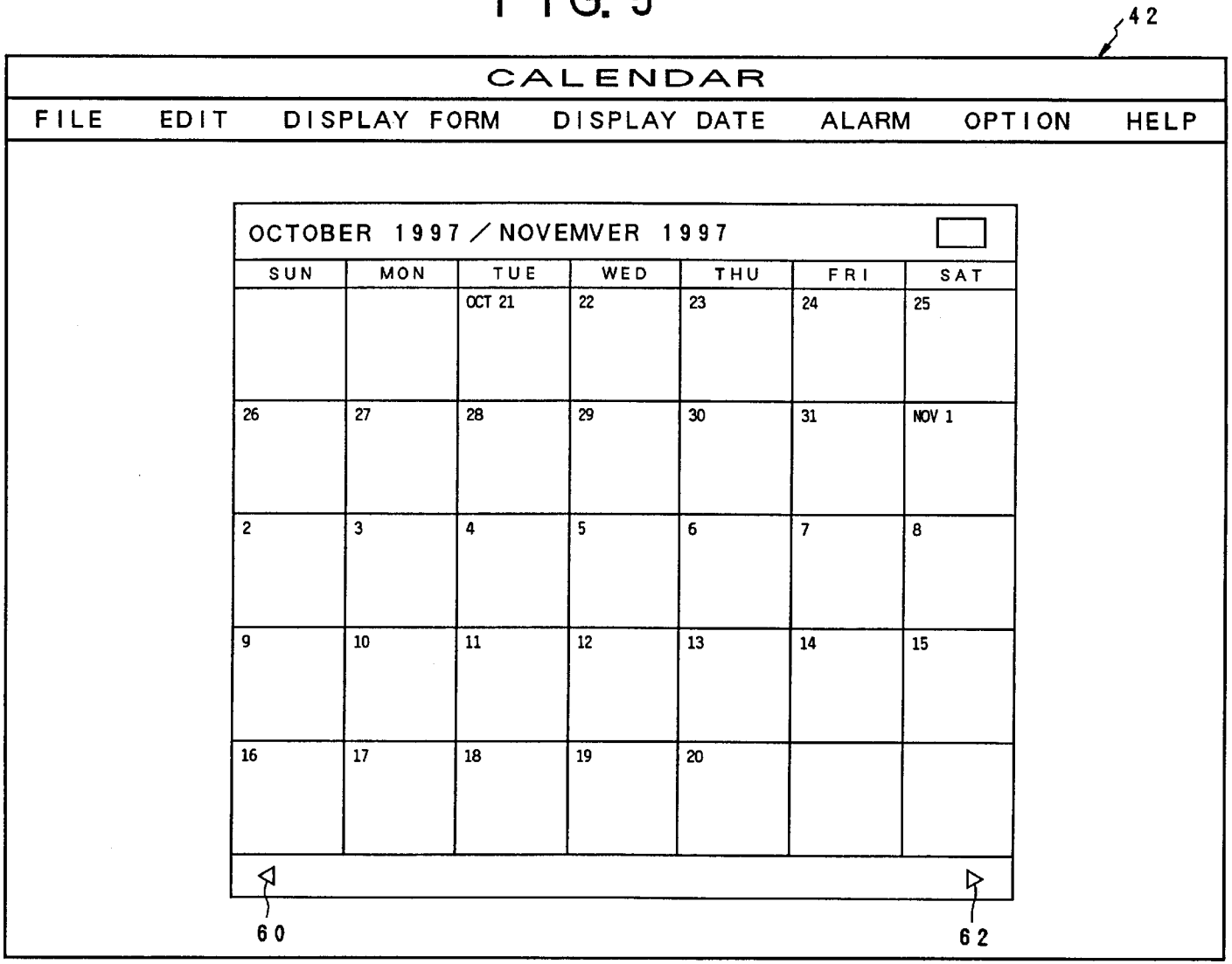
FIG. 5 is an explanatory diagram of the calendar display screen in accordance with the present invention, with the starting day set to 21 and with the starting day-of-week set to Tuesday.

FIG. 4 illustrates a calendar display screen 42 appearing in a case where on the calendar form specification window 48 the start day is set to "21" while simultaneously the standard specification check box 54 is clicked with the mouse. In this case, the layout creating unit 38 of FIG. 2 changes the calendar layout for one month with start day "21" specified by the start day specifying unit 34 ahead, and then changes the display into a calendar form display with a day-of-week of the thus specified start day "21", for example, Tuesday ahead. That is, a calendar display for one month is carried out from Tuesday, Oct. 21, 1997 to November 21 in the next month. On the contrary, in cases where in the calendar form specification window 48 of FIG. 3, "21" is specified as the start day while simultaneously the Sunday specification check box 55 is clicked with the mouse, the display is changed over to a calendar form display in which the start day "21" corresponds to Tuesday in the first week in the day-of-week layout with Sunday ahead as shown in FIG. 5.

Figure 6:
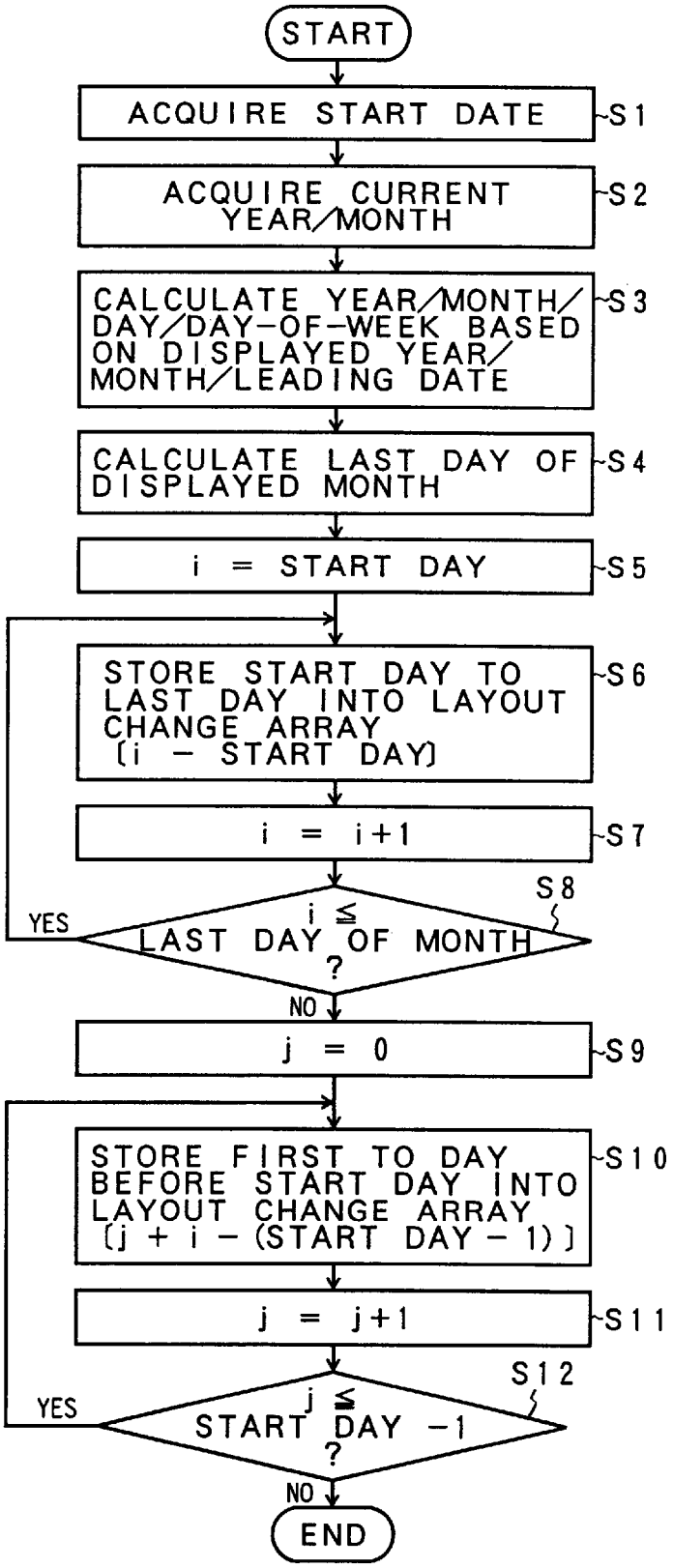
FIG. 6 is a flowchart of calendar management processing of FIG. 2.

FIG. 6 is a flowchart of calendar management processing effected by the function blocks of FIG. 2. First in step S1, a start date is acquired which has been specified by the start date specifying unit 34. For example, in this case, a specified day "21" is acquired through the calendar form specification window 48 of FIG. 3. Then in step S2, a current year/month is acquired from an internal timer of the personal computer. For example, "Oct. 21, 1997" is acquired as the current year/month. Then in step S3, "year/month/day/day-of-week" for one month to be displayed as a calendar is calculated on the basis of the year/month/leading date of the start day "21" to be displayed, that is, "Oct. 21, 1997". Then in step S4, the last day of the displayed month is calculated. Array information of the calendar obtained at that time is depicted in FIG. 7 for example. This array has array Nos. for one month constituting an array [0, 1, 2, . . . , 31], with the array Nos. 0 to 20 storing therein "Nov. 1, 1997 Saturday" to "Nov. 20, 1997 Thursday" in the next month of the month to which the specified start day "21" belongs. The array Nos. 21 to 32 store therein "Oct. 21, 1997 Tuesday" to "Oct. 31, 1997 Friday" relating to the month containing the specified start day "21". In other words, this initial array "0" to "31" is a mere array for one month fetched intactly from the calendars of October and November, 1997, with the specified day "Oct. 21, 1997 Tuesday" ahead.

Referring again to FIG. 6, after the completion of the calculation of "Oct. 31, 1997 Friday" which is the last day of the display month in step S4, processing of steps S5 to S8 is carried out to perform an array conversion of the calendar array "21 to 31" from the specified day "Oct. 21, 1998, Tuesday" to the last day of the display month "Oct. 31, 1997 Friday". First in step S5, the array No. i is initialized to i=start day, that is, i=21 in this case, and then in step S6 a layout change array [i–start day] is found to store the start day to the last day therein. Here i=21, hence Array [i–start day]=array [21–21]=array [0] is obtained. That is, the array No. "21" in FIG. 7 is changed to the array No. "0". Then in step S7, i is incremented by 1 to obtain i=22, and in step S8 the processing of the steps S6 and S7 is repeated until i exceeds "31" which is the last day of the display month. Through these steps S5 to S8, as the layout No. N of FIG. 8 there are figured out N="0 to 10" that is, the array Nos. "0 to 10" corresponding to the start day "21" to the last day "31" of the display month.

Then in steps S9 to S12 of FIG. 6, the array Nos. 0 to 20 of FIG. 7 are changed. In this case, the array No. is defined by j. First in step S9, an initialization is performed to j=0, then in step S10, the array No. after change is found from the layout change array [j+i–start day] to store therein arrays such as "Nov. 11, 1997 Saturday" to "Nov. 20, 1997 Thursday" of FIG. 7. Initially, j=0, hence Array [j+i –(start day –1)]=array [0+31–20]=array [11] is figured out, allowing the array No. 0 of FIG. 7 to be converted to the array No. 11.

Figure 8:
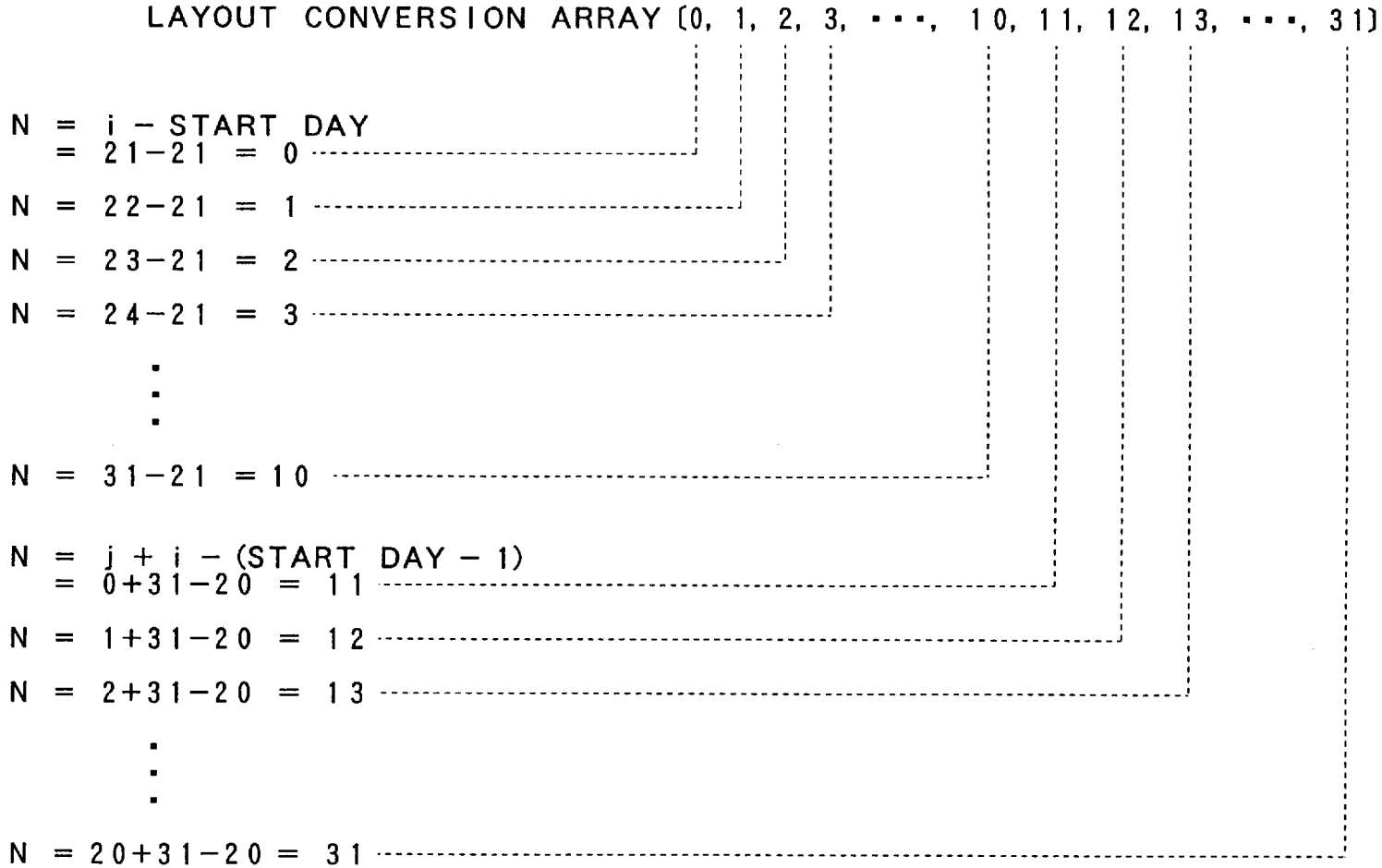
FIG. 8 is an explanatory diagram of calculation processing of layout numbers in the case of changing the calendar layout.

Then in step S10, j is incremented by 1, and thereafter in step S12 the processing of steps S10 to S11 is repeated until j exceeds (Start day –1)=20 days Through the processing of the steps S9 to S12, a conversion of the array Nos. N=10 to 31 of FIG. 8 is carried out. Then, when in step S12, j=21 results, a series of processing is terminated. Through the conversion of the layout change array from the start day to the last day in steps S5 to S8 of FIG. 6, and through the conversion of the layout change array from 1st in the next month to the day before the start day, there can be obtained an array after the change of layout as shown in FIG. 9.

In the array after the change of layout of FIG. 9, the array Nos. are changed in such a manner that the array No. of the start day "Oct. 21, 1997 Tuesday" is 0, with the array Nos. continuing from the last day of the month to the fist day of the next month, and with the last array No. 31 corresponding to the day before the start day of the next month. Accordingly, the calendar display processing unit 40 of FIG. 2 performs a display of the calendar form for one month in conformity with the array Nos. 0 to 31 of the array obtained as a result of the change of the array as in FIG. 9, thereby allowing the calendar display of FIG. 4 to be performed if the start day-of-week is specified by the standard specification at that time, but allowing the calendar display of FIG. 5 if it is specified by the Sunday specification.

Processing of the calendar display processing unit 40 of FIG. 2 to be performed with the acquisition of this layout change array is as follows. First, the region on the screen displaying the date is divided into 35 segments as shown in FIG. 10 on the basis of the number of days-of-week which is seven and the number of weeks which is five. Then, a screen display array is generated which consists of 35 elements having array Nos. 0 to 34 corresponding to the respective segments, with each array No. storing therein coordinate values of four corner points indicating the display position of each segment. These coordinate values are used to determine the display position of the date of each segment. Then, on the basis of the start day-of-week saved in the specified information holding unit 36, processing for displaying the date on each segment is carried out. In case the start day-of-week saved in the specified information holding unit 36 is "standard", displayed on the segments are contents of the screen display array of FIG. 10 corresponding to the array No. "0" as the start day. Furthermore, contents of the layout change array of dates following the start day are in sequence displayed on the respective segments. In other words, the contents of the layout change array are sequentially displayed on each of the segments corresponding to the array Nos. in the screen display array coincident with the array Nos. in the layout change array. Furthermore, in case the start day saved in the specified information holding unit 36 is "Sunday", the following processing is carried out. First, the day-of-week of "0" is acquired which is the start day in the layout change array of FIG. 10. In this example, in case the display start date is "Oct. 21, 1997, Tuesday" is acquired. Then, from the array No. "0" of the thus acquired Tuesday, there is generated an array No. in case the array No. of "Sunday" which is the start day-of-week is "0". That is, if the array No. of Sunday which is the start day-of-week is "0", then the array Nos. "1" to "6" are assigned to Monday, Tuesday, . . . , Saturday, respectively, allowing the array No. "0" of Tuesday which is the start day to be specified to the array No. "2". The thus specified array No. "2" of Tuesday is then added to the array Nos. 0 to 30 of the layout change array of FIG. 9, to thereby generate the array Nos. "2 to 32". Finally, the contents of the array Nos. "2 to 32" of the layout change array after the generation are in sequence displayed on the segments of the array Nos. "2 to 32" coinciding with the screen display array of FIG. 10. In this case, the leading Nos. "0,1" of the screen display array and the last Nos. "33,34" become vacant. This allows a calendar form of FIG. 5 with Sunday ahead to be displayed.

At the bottom of the region of FIGS. 4 and 5 in which the dates of the calendar are displayed, there appear scroll keys 60 and 62. By clicking the scroll key 60 or 62 with the mouse, the display month can be changed. More specifically, when the scroll key 60 is clicked with the mouse, generation is again made of the layout change array from the specified day in one month before the current month displayed to the previous day of the specified day in one month thereafter, thereafter allowing a calendar display. Instead, when the scroll key 62 is clicked with the mouse, generation is again made of the layout change array from the specified day in one month after the current month displayed to the previous day of the specified day in further one month thereafter, allowing a calendar display.

According to the present invention as described hereinabove, the user has only to specify a start day to automatically perform a calendar display for one month with the specified day ahead. In case for example the business term of a company has a time schedule from 21 in each month to 21 in the next month, the calendar display is simple and easy to perform. Furthermore, by specifying the leading day-of-week in addition to the specified day, it is possible to display a calendar form suiting the user's taste.

Although the above embodiment takes the case by way of example where the calendar management system of the present invention has been applied to the personal computer, the present invention is not intended to be limited to this but is applicable intactly to any equipment as long as it is an electronic datebook or other electronic equipment with display device.

The present invention further provides a computer readable record medium storing therein a calendar management program having the function of FIG. 2. On this record medium there are recorded a start date specifying module, a start day-of-week specifying module, a specified information holding module, a layout creating module and a calendar display processing module, respectively, implementing the functions of the start date specifying unit 34, the start day-of-week specifying unit 35, the specified information holding unit 36, the layout creating unit 38 and the calendar display processing unit 40 of FIG. 2.

Such a record medium can be a removable, transportable record medium such as the CD-RCM, the floppy disk, etc., a storage device for a program provider who provides a program by way of lines, or a memory device such as RAM or a hard disk in the processor having a program installed. The calendar management program provided by the record medium is loaded into the processor to be run on its main memory.

Although the above embodiment takes the case by way of example where the specification of the start day-of-week includes the standard form allowing the specification of the day-of-week of the start day and Sunday specification, any day-of-week could naturally be specified as the start day-of-week in the same manner as the start day.

It is further to be appreciated that it is possible to modify the present invention without impairing its object and advantages and that the present invention is not restricted by the numerical values indicated in the embodiments.

What is claimed is:

1. A calendar management system to provide a display of a calendar in conformity with a calendar display form for a one month period, said calendar management system comprising:

a start date specifying unit to specify any date in one month as a start day of a calendar display;

a layout creating unit to create a layout of a calendar for the one month period with said start day specified by said start date specifying unit at the beginning at the calendar layout; and a calendar display processing unit to allow a display of a calendar in conformity with the contents of creation of said layout creating unit.

2. A calendar management system according to claim 1, wherein said layout creating unit creates a calendar layout for the one month period including dates from said specified start day to the last day of a month containing said specified day and dates from the first day in the next month to the previous day of a corresponding day of said specified start day.

3. A calendar management system according to claim 2, wherein when a month containing said specified day is December, said layout creating unit creates a calendar layout for the one month period including dates from said specified start day to the last day of a month containing said specified day and dates from the first day in January in the next year to the previous day of a corresponding day of said specified start day.

4. A calendar management system according to claim 1, further comprising a start day-of-week specifying unit for specifying any day-of-week as a start day-of-week in the one month period, and wherein said layout creating unit further changes to create a layout of a calendar for the one month period which has been changed to have at its leading position a start day specified by said start date specifying unit, into a layout of a calendar for the one month period which has at its leading position a start day-of-week specified by said start.day-of-week specifying unit.

5. A calendar management system according to claim 1, further comprising a start day-of-week specifying unit for specifying Sunday as a start day-of-week in the one month period, and wherein said layout creating unit further changes to create a layout of a calendar for the one month period which has been changed to have at its leading position a start day specified by said start date specifying unit, into a layout of a calendar for the one month period which has at its leading position Sunday specified by said start day-of-week specifying unit.

6. A calendar display control method to control a calendar display in conformity with a calendar display form for a one month period, said method comprising:

a start date specifying step to set any specified date as a start day of a calendar display;

a layout creating step to create a layout of a calendar for the one month period with said specified date at the beginning of the calendar layout; and a calendar display processing step to provide a display of a calendar in conformity with said created layout.

7. A calendar display control method according to claim 6, wherein through said layout creating step there is created a calendar layout for the one month period including dates from said specified start day to the last day of a month containing said specified day and dates from the first day in the next month to the previous day of a corresponding day of said specified start day.

8. A calendar display control method according to claim 7, wherein when a month containing said specified day is December, through said layout creating step there is created a calendar layout for the one month period including dates from said specified start day to the last day of a month containing said specified day and dates from the first day in January in the next year to the previous day of a corresponding day of said specified start day.

9. A calendar display control method according to claim 6, further comprising a start day-of-week specifying step to specify Sunday as a start day-of-week in the one month period, and wherein through said layout creating step, a layout of a calendar for the one month period which has been changed to have at its leading position a start day specified through said start date specifying step is further changed to create a layout of a calendar for the one month period which has at its leading position Sunday specified through said start day-of-week specifying step.

10. A calendar display control method according to claim 7, further comprising a start day-of-week specifying step for specifying Sunday as a start day-of-week in the one month period, and wherein through said layout creating step, a layout of a calendar for the one month period which has been changed to have at its leading position a start day specified through said start date specifying step is further changed to create a layout of a calendar for the one month period which has at its leading position Sunday specified through said start day-of-week specifying step.

11. A computer readable record medium on which is recorded a calendar management program to provide a display of a calendar in conformity with a calendar display form for a one month period, said record medium comprising:

a start date specifying module to specify any date in one month as a start day of a calendar display in a computer;

a layout creating module to create a layout of a calendar for the one month period with said start day specified by said start date specifying module at the beginning of the calendar layout; and a calendar display processing module to allow a display of a calendar in conformity with the contents of creation of said layout creating module.

12. A record medium according to claim 11, wherein said layout creating module creates a calendar layout for the one month period including dates from said specified start day to the last day of a month containing said specified day and dates from the first day in the next month to the previous day of a corresponding day of said specified start day.

13. A record medium according to claim 12, wherein when a month containing said specified day is December, said layout creating module creates a calendar layout for the one month period including dates from said specified start day to the last day of a month containing said specified day and dates from the first day in January in the next year to the previous day of a corresponding day of said specified start day.

14. A record medium according to claim 11, further comprising a start day-of-week specifying module to specify any day-of-week as a start day-of-week in the one month period, and wherein said layout creating module further changes for creation a layout of a calendar for the one month period which has been changed to have at its leading position a start day specified by said start date specifying module, into a layout of a calendar for the one month period which has at its leading position a start day-of-week specified by said start day-of-week specifying module.

15. A record medium according to claim 11, further comprising a start day-of-week specifying module to specify Sunday as a start day-of-week in the one month period, and wherein said layout creating module further changes for creation a layout of a calendar for the one month period which has been changed to have at its leading position a start day specified by said start date specifying module, into a layout of a calendar for the one month period which has at its leading position Sunday specified by said start day-of-week specifying module.

16. A calender management method, displaying a one month calendar form, comprising:

specifying a date as a start day of a calendar display;

creating a layout of a calendar, the layout being a length of one month period, said specified date being set at the beginning of the calendar layout in the calendar layout, and with the layout overlapping dates in two months if the specified date is not the first date of a month; and displaying said layout of the calendar.

17. A calender management apparatus, displaying a one month calendar form, comprising:

a specifying unit to specify a date as a start day of a calendar display;

a layout unit to create a layout of a calendar, the layout being a length of one month period, said specified date being set at the beginning of the calendar layout in the calendar layout, and with the layout overlapping dates in two months if the specified date is not the first date of a month; and a display to display said layout of the calendar.

* * * * *